US008177516B2

(12) United States Patent
Moors et al.

(10) Patent No.: US 8,177,516 B2
(45) Date of Patent: May 15, 2012

(54) SHAPED ROTOR WHEEL CAPABLE OF CARRYING MULTIPLE BLADE STAGES

(75) Inventors: Thomas Michael Moors, Simpsonville, SC (US); Joseph Jay Jackson, Greer, SC (US)

(73) Assignee: General Electric Company, Schenectady, NY (US)

( * ) Notice: Subject to any disclaimer, the term of this patent is extended or adjusted under 35 U.S.C. 154(b) by 32 days.

(21) Appl. No.: 12/698,291

(22) Filed: Feb. 2, 2010

(65) Prior Publication Data

US 2011/0189022 A1 Aug. 4, 2011

(51) Int. Cl.
*F04D 29/04* (2006.01)

(52) U.S. Cl. ..... 416/244 A; 415/216.1

(58) Field of Classification Search ..... 415/199.5, 415/199.4, 198.1; 416/198 R, 199, 200 A, 416/198 A, 244 A, 216.1, 234, 193 R
See application file for complete search history.

(56) References Cited

U.S. PATENT DOCUMENTS

| | | | | |
|---|---|---|---|---|
| 3,249,293 | A * | 5/1966 | Koff | 416/198 A |
| 4,088,422 | A * | 5/1978 | Martin | 416/198 A |
| 4,483,054 | A * | 11/1984 | Ledwith | 416/198 A |
| 6,494,683 | B1 | 12/2002 | Nolan et al. | |
| 7,322,101 | B2 * | 1/2008 | Suciu et al. | 415/199.5 |
| 2007/0020135 | A1 * | 1/2007 | Jackson et al. | 419/29 |

* cited by examiner

*Primary Examiner* — Richard Edgar
(74) *Attorney, Agent, or Firm* — Hoffman Warnick LLC; Ernest G. Cusick

(57) ABSTRACT

A shaped rotor wheel, a turbo machine including the rotor wheel, and a method for producing the same are disclosed. In an embodiment, a rotor wheel is provided which includes at least one disk member and at least one spacer member, and is a capable of carrying and axially spacing one or more stages of blades. Also disclosed is a method for producing such a rotor wheel using metal powders as a starting material, and processing the metal powder using powder metallurgy techniques.

9 Claims, 5 Drawing Sheets

SHAPED ROTOR WHEEL CAPABLE OF CARRYING MULTIPLE BLADE STAGES

BACKGROUND OF THE INVENTION

The invention relates generally to turbo machines such as turbines or compressors, and more particularly, to a turbo machine rotor including a rotor wheel capable of carrying and spacing one or more stages of rotor blades. The rotor wheel is formed using a metal powder as a starting material, and processed using powder metallurgy techniques.

Turbo machines such as turbines and compressors include a rotor, which further includes a rotating shaft with a plurality of axially spaced rotor wheels mounted thereon. Typically, each rotor wheel holds one stage of blades, with the blades mechanically coupled to each rotor wheel and arranged in rows extending circumferentially around each rotor wheel. The axially spaced rotor wheels are typically joined to one another by bolting or welding. These features result in rotors having heavy weights, increased start times, and complex joints. Rotors may also require a spacer rotor wheel to be bolted or welded between each of the plurality of rotor wheels to provide proper spacing between blade stages. Alternatively, rotor wheels have been formed from a single steel monoblock forging, which has limited ranges of operating temperatures and tensile strengths.

BRIEF DESCRIPTION OF THE INVENTION

A first aspect of the disclosure provides a rotor wheel comprising: a unitary base including a nickel-based superalloy, wherein the unitary base has a shape including: a first disk member for carrying a first stage of rotor blades, and a first spacer member axially extending from a first end face of the first disk member; the first disk member including a plurality of axially spaced, radially outwardly extending slots about an outer circumference of the first disk member for receiving a rotor blade.

A second aspect of the disclosure provides a turbo machine comprising: a rotor including: at least one rotor wheel, each of the at least one rotor wheels including: a unitary base including a nickel-based superalloy, wherein the unitary base has a shape including: a first disk member for carrying a first stage of rotor blades, and a first spacer member axially extending from a first end face of the first disk member; the first disk member including a plurality of axially spaced, radially outwardly extending slots about an outer circumference of the first disk member for receiving a rotor blade; and a plurality of stationary vanes extending circumferentially around the shaft, and positioned axially adjacent to the stage of rotor blades.

A third aspect of the disclosure provides a method comprising: atomizing a nickel-based superalloy to produce a powder; filling a can with the powder and evacuating and sealing the can in a controlled environment; consolidating the can and the powder therein at a temperature, time, and pressure to produce a consolidation; hot working the consolidation to produce a rotor wheel, wherein the rotor wheel includes: a unitary base including a nickel-based superalloy, wherein the unitary base has a shape including: a first disk member for carrying at least one stage of rotor blades, and a first spacer member axially extending from the at least one disk member; and machining a plurality of axially spaced, radially outwardly extending slots into an outer circumference of each of the at least one disk members, each of the plurality of slots being dimensioned to receive a rotor blade.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

At least one embodiment of the present invention is described below in reference to its application in connection with the operation of a gas or steam turbine. Although embodiments of the invention are illustrated relative to a gas or steam turbine, it is understood that the teachings are equally applicable to other turbo machines including, but not limited to, compressors. Further, at least one embodiment of the present invention is described below in reference to a nominal size and including a set of nominal dimensions. However, it should be apparent to those skilled in the art that the present invention is likewise applicable to any suitable turbo machine. Further, it should be apparent to those skilled in the art that the present invention is likewise applicable to various scales of the nominal size and/or nominal dimensions.

As indicated above, aspects of the invention provide a turbo machine structure. FIGS. 4-10 show different aspects of a turbo machine environment and a rotor wheel structure 19 in accordance with embodiments of the present invention, and a method of making the same.

Figure 1:
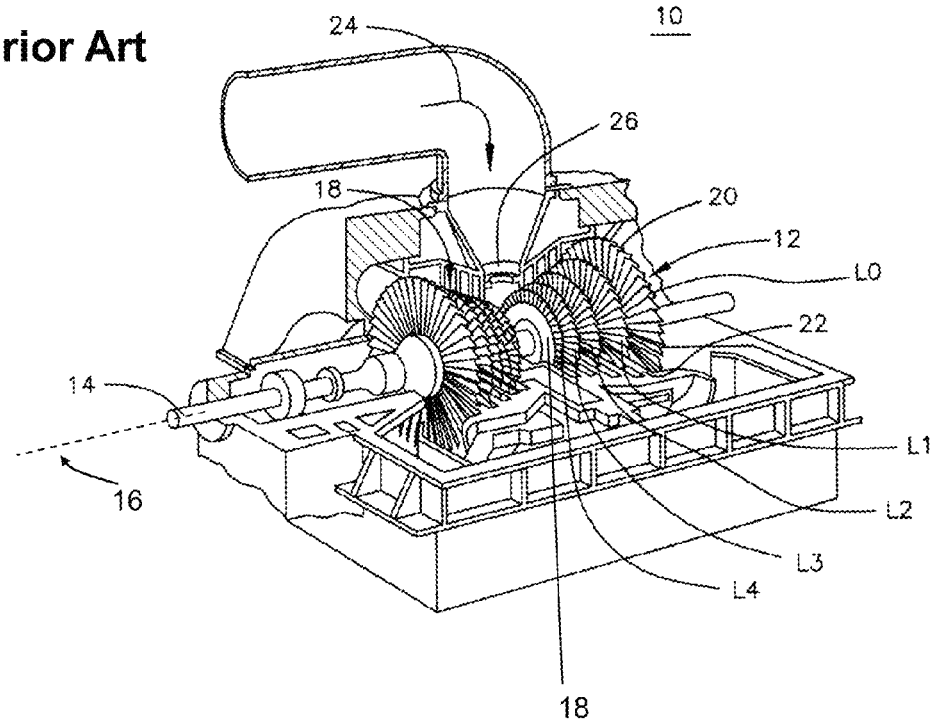
FIG. 1 Prior Art
FIG. 1 shows a perspective partial cut-away illustration of a conventional steam turbine.
Figure 2:
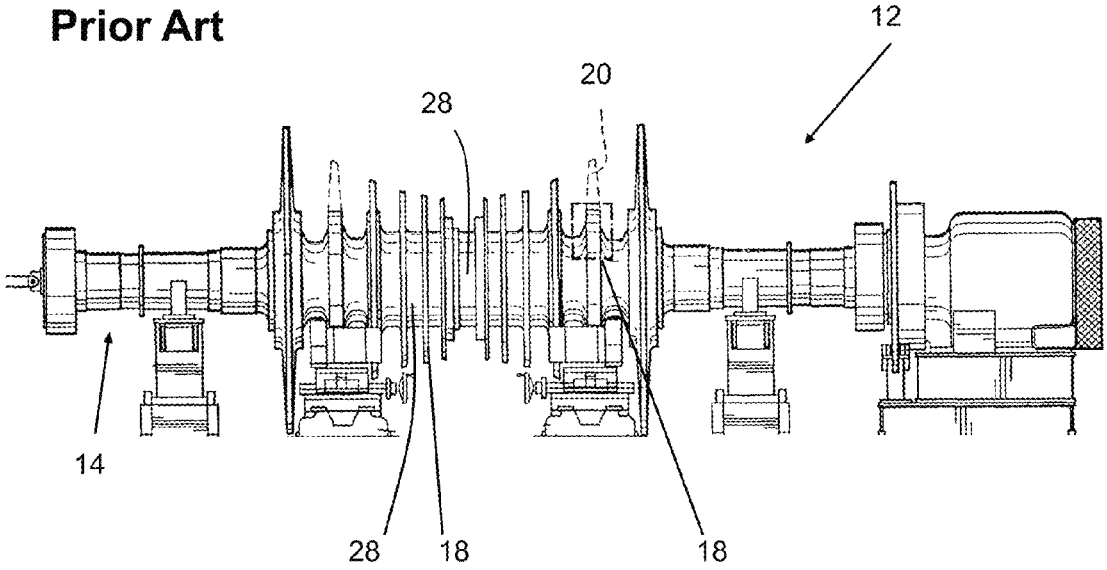
FIG. 2 Prior Art
FIG. 2 shows a cross-sectional view of a conventional turbine rotor, illustrating the environment of the present invention.

Referring to the drawings, FIGS. 1-2 show an illustrative turbo machine in the form of a steam turbine 10. Steam turbine 10 includes a rotor 12 that includes a shaft 14 which rotates about axis 16 (FIG. 2) and a plurality of axially spaced rotor wheels 18 mounted to shaft 14, and rotating therewith. Each rotor wheel 18 carries a plurality of blades 20 which are mechanically coupled thereto, and are arranged in rows that extend circumferentially around each rotor wheel 18. Each conventional rotor wheel 18 carries a single row or stage of blades 20. A plurality of stationary vanes 22 extend circumferentially around shaft 14, axially positioned between adjacent rows of blades 20. Stationary vanes 22 cooperate with blades 20 to form a stage and to define a portion of a steam flow path through turbine 10.

Referring to FIG. 1, during operation, steam 24 enters an inlet 26 of turbine 10 and is channeled through stationary vanes 22. Vanes 22 direct steam 24 downstream against blades 20. Steam 24 passes through the remaining stages imparting a force on blades 20 causing shaft 14 to rotate. At least one end of turbine 10 may extend axially away from rotor 12 and may be attached to a load or machinery (not shown) such as, but not limited to, a generator, and/or another turbine.

In various embodiments of the present invention turbine 10 comprises various numbers of stages. FIG. 1 shows five stages, which are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, and each turbine may have more or less than five stages, as in FIG. 2, which shows three stages.

Figure 3:
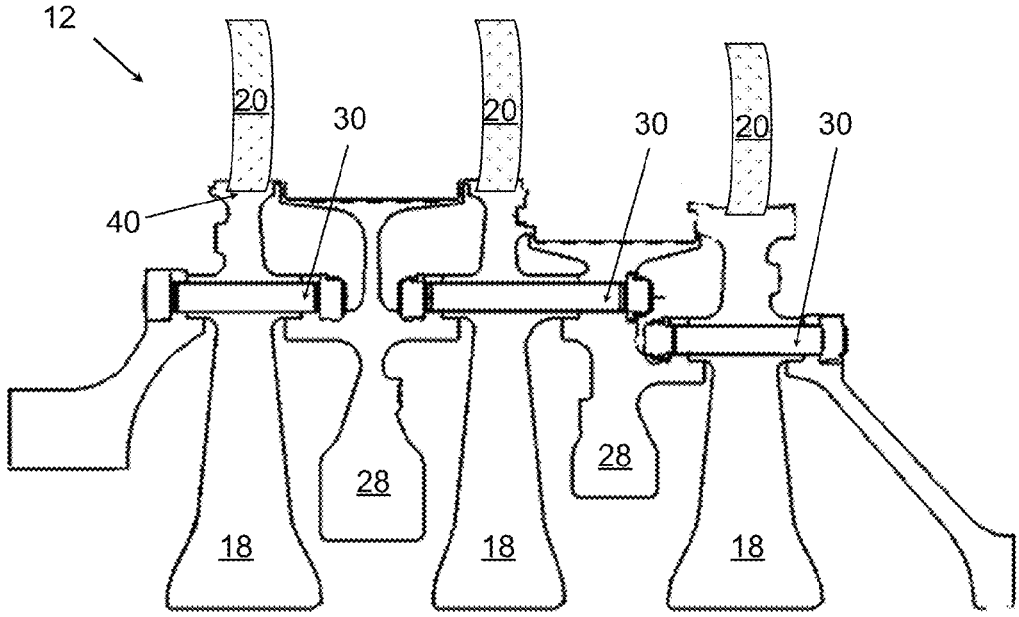
FIG. 3 Prior Art
FIG. 3 shows a cross sectional view of a section of a rotor including a conventional approach of welding or bolting rotor wheels.

As noted, FIGS. 1-3 show a conventional arrangement in which each rotor wheel 18 carries a single row of blades 20. In this arrangement, rotor wheels 18 carry successive stages of blades are axially spaced or distanced from one another by spacers 28. In such an arrangement, rotor wheels 18 are typically approximately pancake shaped. Rotor wheels 18 and spacers 28 may be forged separately, and subsequently affixed to one another by bolts 30 and/or welding (FIG. 3). Alternatively, as depicted in FIG. 2, rotor 12 may be made from a steel monoblock forging, and rotor wheels 18 and spacers 28 may be machined into the steel.

FIGS. 4-10 depict rotor wheel 19 according to various embodiments of the invention. Rotor wheel 19 is irregularly shaped, and comprises a unitary base 34 which includes at least a first disk member 36 and at least a first spacer member 38. Each disk member 36 carries a row, or stage of rotor blades 20. First spacer member 38 extends axially, either distally or proximally, from an end face of first disk member 36. The formation of unitary base 34, including both disk member(s) 36 and spacer member(s) 38 eliminates the need to bolt 30 or weld a separately forged spacer 28 (FIG. 3) to a rotor wheel. The length of spacer member 38 as it extends axially is substantially equivalent to the thickness of a conventional spacer 28 (FIG. 3) required for a given rotor 12 and turbine 10 design. In some embodiments, spacer member 38 may be hollowed out to reduce the weight of rotor wheel 19.

In an embodiment, each disk member 36 may have an outer diameter 44 of up to about 3 meters (about 120 inches). The outer diameter 44 is of sufficient thickness to provide the necessary hoop strength to prevent rotor burst. Spacer member 38 may have a second, narrower outer diameter 46 as compared to outer diameter 44 of disk members 36 (FIGS. 4-7, 10), or may be of similar outer diameter as disk member 36 (FIGS. 8-9) as required by a given turbine 10 design. Spacer member 38 is dimensioned to provide sufficient material to distribute radial stresses.

Each disk member 36 includes a plurality of slots 40 machined into an outer circumference of disk member 36 such that slots 40 are axially spaced and radially outwardly extending according to conventional blade 20 attachment techniques. (FIGS. 3-10.) Each slot 40 is dimensioned to receive a blade 20. Any known connection may be used to mechanically couple blades 20 to rotor wheels 18, 19, including but not limited to conventional dovetail attachment techniques.

Figure 4:
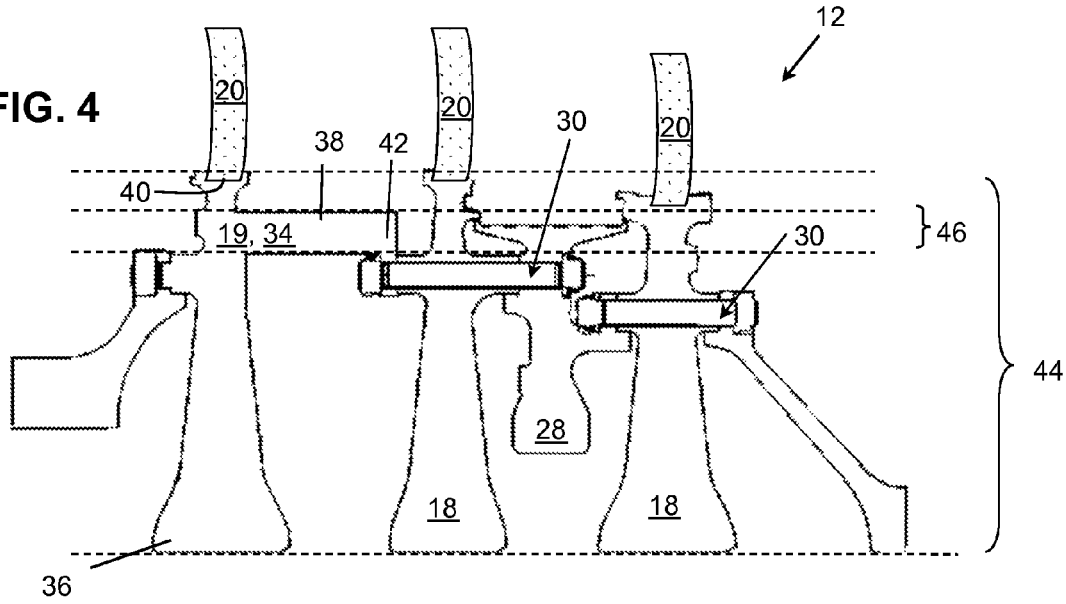
FIG. 4 shows a cross sectional view of a section of a rotor including a rotor wheel serving the function of a rotor wheel and a spacer according to one embodiment of the invention.
Figure 5:
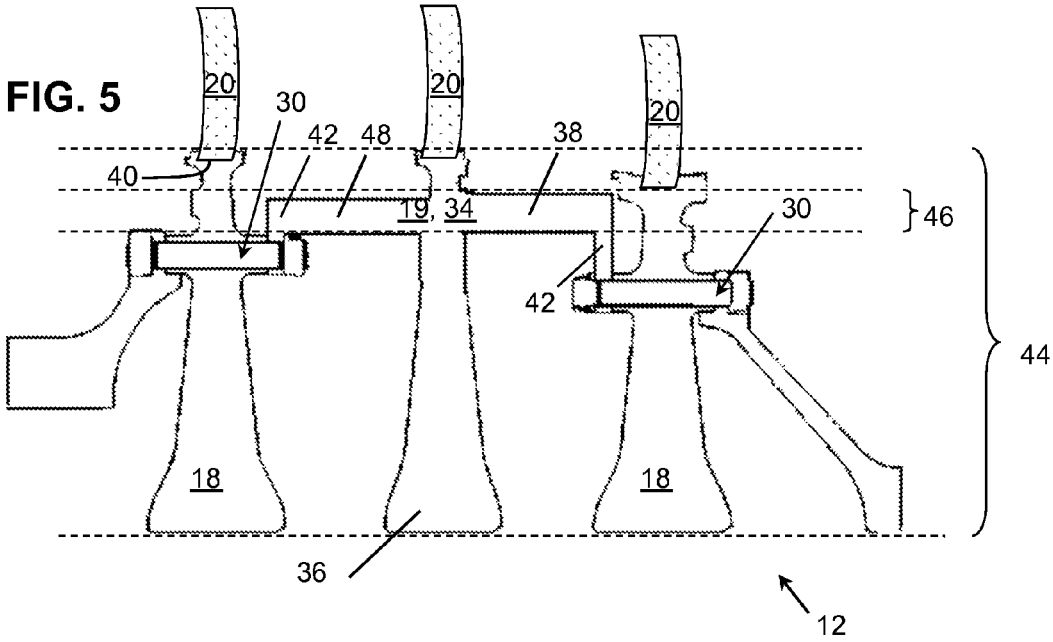
FIG. 5 shows a cross sectional view of a section of a rotor including a rotor wheel serving the function of a rotor wheel and two spacers according to one embodiment of the invention.

As shown in FIGS. 4-5, rotor wheel 19 may further include a flange 42 on each end of rotor wheel 19, located on an end face of a terminal spacer member 38. Flange 42 provides an attachment point, allowing successive rotor wheels 19 to be affixed to one another to produce a rotating shaft including multiple rotor wheels 18, 19 to carry a plurality of stages of blades. Rotor wheels 19 may be affixed to additional rotor wheels 19, conventional rotor wheels 18 (FIGS. 4-5), or conventional spacers 28 (FIG. 6) by any known means, including, for example, bolts 30 or welding.

In various embodiments of the invention, rotor wheel 19 is capable of serving the function of one or more conventional rotor wheels 18 and one or more one conventional spacers 28. In the embodiment depicted in FIG. 5, in addition to first disk member 36 and first spacer member 38, unitary base 34 further includes a second spacer member 48. Second spacer member 48 axially extends from first disk member 36 in a direction opposite the direction of the first spacer member 38, such that first disk member 36 is disposed axially between the first spacer member 38 and the second spacer member 48. In this embodiment, a single rotor wheel 19 serves the function of carrying one stage of blades 20, and the spacing conventionally accomplished by two spacers 28 arranged with one spacer 28 on each side of conventional rotor wheel 18 (as in FIG. 3).

Figure 6:
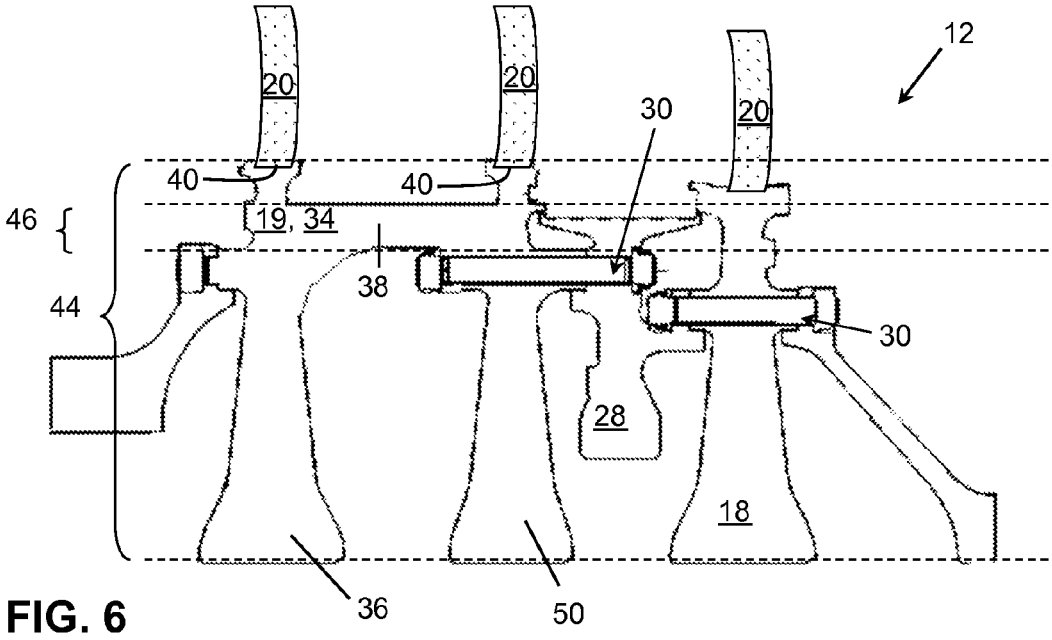
FIG. 6 shows a cross sectional view of a section of a rotor including a rotor wheel serving the function of two rotor wheels and a spacer according to one embodiment of the invention.
Figure 8:
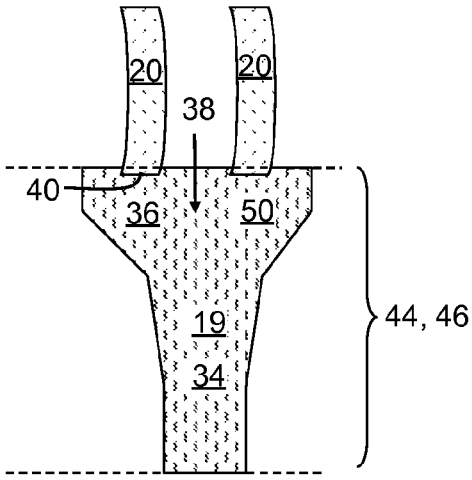
FIG. 8 shows a cross sectional view of part of a rotor wheel carrying two stages of blades according to an embodiment of the invention.
Figure 10:
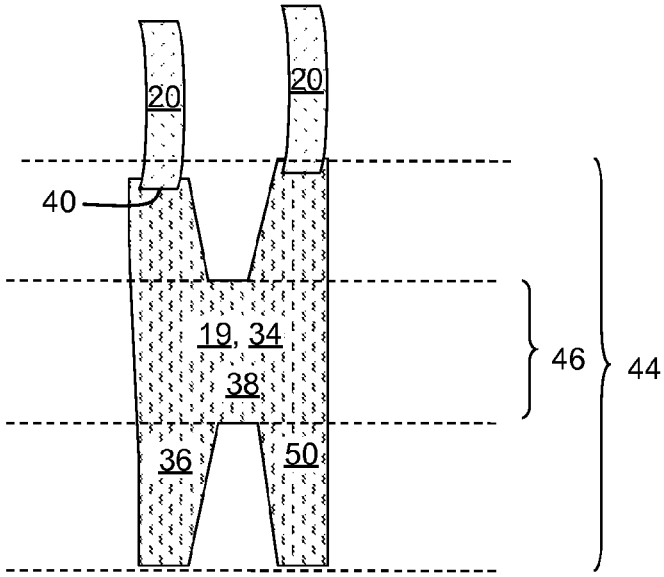
FIG. 10 shows a cross sectional view of part of a rotor wheel carrying two stages of blades, according to an embodiment of the invention.

In the embodiment depicted in FIGS. 6, 8, and 10, in addition to first disk member 36 and first spacer member 38, unitary base 34 further includes a second disk member 50. First spacer member 38 extends axially between first disk member 36 and the second disk member 50. In this embodiment, a single rotor wheel 19 serves the function of carrying two stages of blades 20, and the spacing conventionally accomplished by one spacer 28 disposed between and affixed to a first and second rotor wheel 18 (as in FIG. 3).

Figure 9:
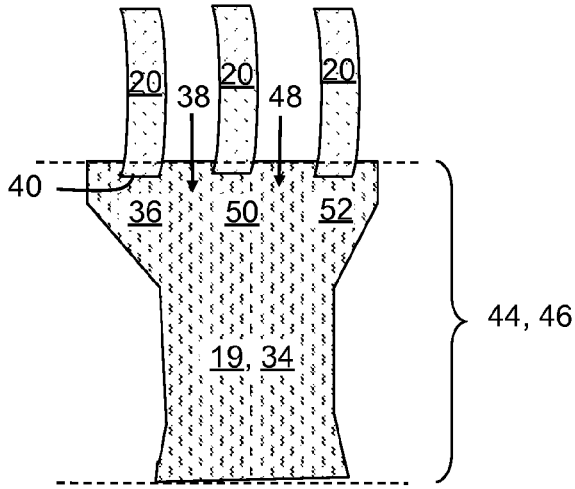
FIG. 9 shows a cross sectional view of part of a rotor wheel carrying three stages of blades according to an embodiment of the invention.

In various embodiments, as depicted in FIGS. 8-9, spacer member 38, 48 in rotor wheel 19 may have an outer diameter 46 that is similar to or the same as the outer diameter 44 of disk member 36. In such embodiments, first, second, and any subsequent disk members 36, 50, 52, etc., may be collapsed such that disk members 36, 50, 52 are not visibly distinct from one another. As in the embodiment depicted in FIGS. 4-7 and 10, however, spacer member 38 may have a smaller outer 46 diameter than that of disk member 36.

Figure 7:
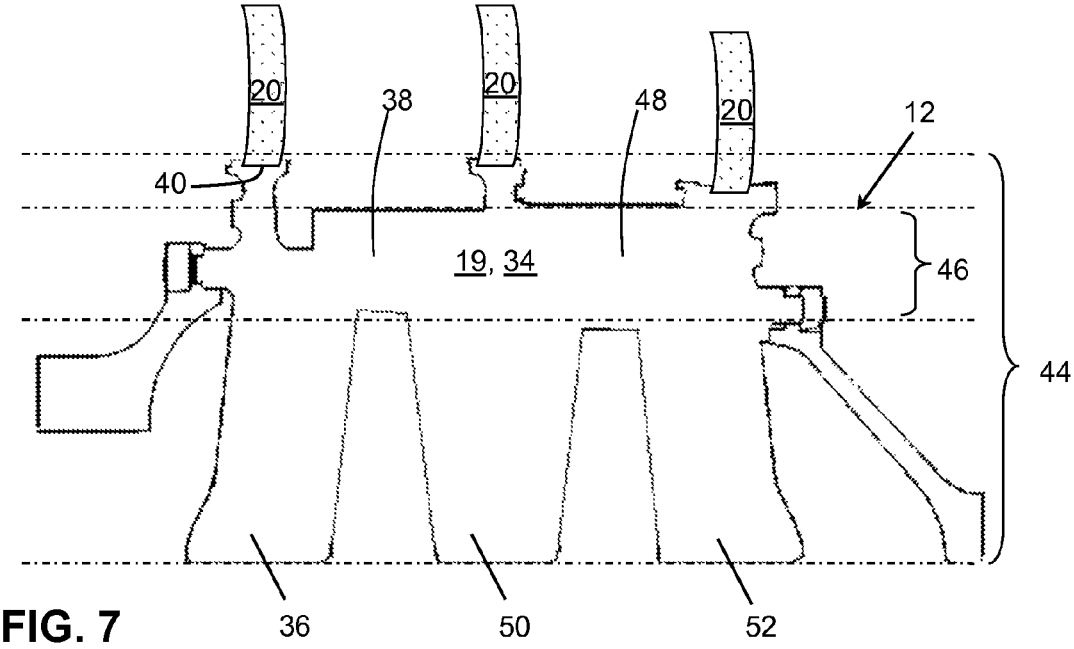
FIG. 7 shows a cross sectional view of a section of a rotor including a rotor wheel serving the function of three rotor wheels and two spacers according to one embodiment of the invention.

In the embodiment depicted in FIGS. 7 and 9, in addition to first disk member 36 and first spacer member 38, unitary base 34 further includes a second and a third disk member 50, 52 and second spacer member 48. As described relative to FIG. 6, first spacer member 38 extends axially between first disk member 36 and second disk member 50. Second spacer member 48 axially extends from second disk member 50 in a direction opposite that of the first spacer member 38. Third disk member 52 is located axially adjacent to second spacer member 48, such that second spacer member 48 extends axially between second and third disk members 50, 52. In this embodiment, a single rotor wheel 19 serves the function of carrying three stages of blades 20, and the spacing conventionally accomplished by two spacers 28 disposed there between (as in FIG. 3).

In other embodiments, rotor wheel 19 may carry as many stages of blades 20 as unitary base 34 includes disk members 36, 50, 52, etc. The embodiments depicted in FIGS. 4-7 are illustrative, and are not intended to limit the possible embodiments to only those combinations and numbers of disk members and spacer members depicted.

In various embodiments, unitary base 34 may be made of any of a variety of suitable superalloys, including nickel based super alloys. In some embodiments, the superalloys may be precipitation-strengthened nickel-based superalloys. In various embodiments, the superalloys may have compositions by weight as approximately described in Table 1.

TABLE 1

| | approximate compositions by weight | | | | | | |
|---|---|---|---|---|---|---|---|
| | Fe | Cr | Al | Ti | Mo | Nb | Ni |
| Composition 1 | bal | 16 | 0 | 1.65 | ≦0.12 | 3 | 42 |
| Composition 2 | 18 | 18 | 0.5 | 0.9 | 0.2 | 5.1 | 54 |
| Composition 3 | 5 | 20 | 0.5 | 1.5 | 7.5 | 3.5 | bal |

The foregoing superalloy compositions are not intended to be an exhaustive recitation, however, and are merely illustrative of alloy compositions with suitable tensile properties and time dependent crack growth resistance.

The composition of rotor wheel 19 allows turbine 10, and consequently rotor 12 including rotor wheel 19 to operate at much higher temperatures than conventional steel forgings, e.g., at temperatures of up to about 650° C. (about 1200° F.). Rotor wheel 19 further exhibits a tensile yield strength (0.2% yield) of greater than 483 MPa (about 70 ksi) at 538° C. (about 1000° F.). In some embodiments, rotor wheel 19 exhibits a tensile strength (0.2% yield) of about 690 MPa (about 100 ksi) to about 1,069 MPa (about 155 ksi), and further embodiments, about 724 MPa (about 105 ksi) to about 931 MPa (about 135 ksi), allowing for operation at higher speeds.

Further provided is a process for producing rotor wheel 19 using powder metallurgy techniques. The use of powder metallurgy processes to form rotor wheels 19 allows for the formation of more complex geometric shapes, such as depicted in FIGS. 4-7, and greater tensile strength than achievable through steel monoblock forging (FIG. 2).

Under vacuum or in an inert environment, hereinafter referred to as a "controlled environment," a melt is formed having the chemistry of the desired alloy. While in molten condition and within the desired chemistry specifications, the alloy is converted to powder by atomization or other suitable process to produce approximately spherical powder particles. Because of the large quantity of powder required to produce rotor wheel 19, it may be necessary to blend powders produced from multiple atomization steps. Any powder storage required preferably takes place in a controlled environment.

A can is provided, having a design and material composition that are capable of containing and handling the powder at this stage without distortion. In various embodiments, the can may be made of steel, stainless steel, superalloy, or another suitable material. The can is irregularly shaped substantially in accordance with the desired shape of rotor wheel 19, and includes the geometry necessary to form unitary base 34 including disk members 36 and spacer member 38. In various embodiments, it has an outer diameter of up to about 3 meters (about 120 inches).

The can is filled with the alloy powder in a controlled environment, evacuated to drive off moisture and any volatiles, and sealed while remaining in the controlled environment. The can and the powder are then consolidated at a temperature, time, and pressure sufficient to produce a consolidation. In various embodiments, the consolidation may be accomplished using hot isostatic pressing or any other suitable consolidation method.

The consolidation is then hot worked using any suitable technique to refine the shape of rotor wheel 19. Suitable hot working techniques include, for example, rolled ring forging, extrusion, forging, incremental forging, and die forging, including open die forging, closed die forging, hot die forging, and isothermal forging. The resulting rotor wheel 19 is shaped as described herein. Spacer member 38 may be hollowed out to reduce weight through the can design, a forging process, or machining.

A plurality of slots 40 arranged are then machined in a row into an outer circumference of each of the at least one disk member 36. Each slot 40 is dimensioned to receive a blade 20. Blades 20 are mechanically coupled to rotor wheel 19 via slots 40 using any known technique, such as dovetail attachment. Dovetail connections, including cooperating wheel hooks and bucket hooks, are well known in the art. In various embodiments, rotor wheel 19 may include one, two, three, or more rows of slots 40 machined into as many adjacent disk members 36 to receive one, two, three, or more rows of blades 20, respectively, forming one (FIGS. 4-5), two (FIG. 6), three (FIG. 7), or more stages of blades 20 to be carried by a single rotor wheel 19.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A rotor wheel comprising:

a unitarily formed base including consolidated powder metal, wherein the powder metal further includes a nickel-based superalloy, wherein the unitarily formed base has a shape including:

a first disk member for carrying a first stage of rotor blades, second disk member for carrying a second stage of rotor blades, a third disk member for carrying a third stage of rotor blades, a first spacer member axially extending between, and joining a distal face of the first disk member and a proximal face of the second disk member, and a second spacer member axially extending between, and joining a distal face of the second disk member and a proximal face of the third disk member;

wherein each of the first disk member, the second disk member, and the third disk member include a plurality of axially spaced, radially outwardly extending slots about an outer circumference of each of the first disk member, the second disk member, and the third disk member for receiving a rotor blade, and wherein a tensile yield strength of the unitarily formed base is uniform throughout the first disk member, the first spacer member, the second disk member, the second spacer member, and the third disk member.

2. The rotor wheel of claim 1, wherein the rotor wheel operates at an operating temperature of up to about 650° C.

3. The rotor wheel of claim 1, wherein a tensile strength of the superalloy is about 0.2% yield at greater than about 483 MPa.

4. The rotor wheel of claim 1, wherein the nickel-based superalloy is selected from the group consisting of: Composition 1, Composition 2, and Composition 3.

5. A turbo machine comprising:

a rotor including:

at least one rotor wheel, each of the at least one rotor wheels including:

unitarily formed base including consolidated powder metal, wherein the powder metal further includes a nickel-based superalloy, wherein the unitarily formed base has a shape including:

a first disk member for carrying a first stage of rotor blades, a second disk member for carrying a second stage of rotor blades, a third disk member for carrying a third stage of rotor blades, a first spacer member axially extending between, and joining a distal face of the first disk member and a proximal face of the second disk member, and a second spacer member axially extending between, and joining a distal face of the second disk member and a proximal face of the third disk member;

wherein each of the first disk member, the second disk member, and the third disk member include a plurality of axially spaced, radially outwardly extending slots about an outer circumference of each of the first disk member, the second disk member, and the third disk member for receiving a rotor blade, and wherein a tensile yield strength of the unitarily formed base is uniform throughout the first disk member, the first spacer member, the second disk member, the second spacer member, and the third disk member.

6. The turbo machine of claim 5, wherein the rotor wheel operates at an operating temperature of up to about 650° C.

7. The turbo machine of claim 5, wherein a tensile strength of the superalloy is about 0.2% yield at greater than about 483 MPa.

8. The turbo machine of claim 5, wherein the nickel-based superalloy is selected from the group consisting of: Composition 1, Composition 2, and Composition 3.

9. A method comprising:

atomizing a nickel-based superalloy to produce a powder;

filling a can with the powder and evacuating and sealing the can in a controlled environment;

consolidating the can and the powder therein at a temperature, time, and pressure to produce a consolidation;

hot working the consolidation to produce a rotor wheel, wherein a tensile yield strength of the rotor wheel is uniform throughout the rotor wheel, and wherein the rotor wheel includes:

a unitarily formed base including a nickel-based superalloy, wherein the unitarily formed base has a shape including:

a first disk member for carrying at least one stage of rotor blades, a second disk member for carrying a second stage of rotor blades, a third disk member for carrying a third stage of rotor blades, a first spacer member axially extending between, and joining a distal face of the first disk member and a proximal face of the second disk member, and a second spacer member axially extending between, and joining a distal face of the second disk member and a proximal face of the third disk member; and machining a plurality of axially spaced, radially outwardly extending slots into an outer circumference of each of the first disk member, the second disk member, and the third disk member, each of the plurality of slots being dimensioned to receive a rotor blade.

* * * * *